US006448785B1

(12) United States Patent
Rohmer et al.

(10) Patent No.: US 6,448,785 B1
(45) Date of Patent: Sep. 10, 2002

(54) FUSE PULLER WITH CONTINUITY INDICATOR

(75) Inventors: Richard Rohmer, Jordan; Thomas J. Livingston, Homer, both of NY (US)

(73) Assignee: Pass & Seymour, Inc., Syracuse, NY (US)

( * ) Notice: Subject to any disclaimer, the term of this patent is extended or adjusted under 35 U.S.C. 154(b) by 17 days.

(21) Appl. No.: 09/591,361

(22) Filed: Jun. 9, 2000

(51) Int. Cl.[7] ..... H01H 85/30

(52) U.S. Cl. ..... 324/550; 337/194; 337/198; 361/835; 439/622; 340/639

(58) Field of Search ..... 324/550, 548, 324/555, 559, 601; 337/186, 198, 194, 210; 439/621, 622; 340/467, 619, 631, 639; 361/835

(56) References Cited

U.S. PATENT DOCUMENTS 4,475,283 A * 10/1984 Olson ..... 29/720
5,488,345 A * 1/1996 Yoshinobu ..... 337/186
5,662,496 A * 9/1997 Kanamori ..... 439/621
5,751,208 A * 5/1998 Martinez ..... 337/198

* cited by examiner

*Primary Examiner*—Michael Sherry
*Assistant Examiner*—Trung Nguyen
(74) *Attorney, Agent, or Firm*—Wall Marjama & Bilinski LLP

(57) ABSTRACT

A fuse extractor and puller including a generally cylindrical fuse receiving portion, a lifting and inserting tower attached to the cylindrical fuse receiving portion, and a gripping head attached to the tower and having specially molded characters etched thereon. The tower portion of the fuse puller is hollow and incorporates a continuity detector having an indicator for indicating the condition of a fuse comprising a light extending through the top of the gripping portion, and first and second spring contacts attached to the continuity detector, adapted to contact the electrical terminals of a fuse positioned within the puller. The tower further includes a cantilevered support for supporting the continuity detector so that the light may be pressed downwardly against the gripping portion and the stress created thereby is absorbed, preventing damage to the light.

15 Claims, 4 Drawing Sheets

FUSE PULLER WITH CONTINUITY INDICATOR

FIELD OF THE INVENTION

This invention relates generally to high power electrical components and more particularly to a fuse puller for a cartridge type fuse in an electrical device, which puller includes a continuity indicator for indicating the condition of the fuse.

BACKGROUND OF THE INVENTION

Large cylindrical cartridge fuses are widely used in high power electrical contactors, switches, and similar electrical devices. Such fuses may have cylindrical or flat ends adapted to engage a fuse holder for creating a secure mechanical connection and a low resistance electrical connection. Because of the large current carried by such fuses, a substantial contact area is required between the fuse and the fuse holder. Substantial pressure is exerted by the fuse holder on the contact surfaces of the fuse, which although it holds the fuse securely in position and reduces the resistance between the fuse and the holder, thereby reducing the tendency of the fuse to arc and increasing the current carrying capacity, makes it difficult to remove and replace the fuse. Moreover, fuse holders are oftentimes positioned close together when multiple phases are fused, and this makes removing and replacing the fuses even more difficult.

Heretofore, there have been a number of approaches to providing apparatus for assisting a user in removing and replacing a fuse. Fuse grippers have long been known that are configured generally like pliers, but have jaws with cylindrical openings adapted to engage a fuse to pull it from the fuse holder, and replace it as required. More recently, flexible plastic fuse holders have been employed that extend under the body of the fuse to allow the fuse to be lifted with a finger of a user, for example, and withdrawn from the fuse holder.

Although such fuse extractors are more or less effective, they do not assist the user in replacing a blown fuse with a substitute fuse, since for the most part they cannot be used to exert downward pressure on a fuse.

Before now, when a failure such as an overload, a short-circuit, or another failure, occurred, that resulted in a fuse blowing, it had been necessary to shut down the power to the device and identify the blown fuse. The blown fuse would be identified with a continuity tester or the like, remove the fuse from the fuse block and replace it with a new fuse. Because of the high currents involved in circuits of the type to which this invention relates, the fuse box and fuses have physically large contacts and substantial pressures exist between the fuse contacts and the retaining clips of the fuse block. While this provides low resistance electrical connections to the fuses and reduces heating losses, it makes the fuses physically difficult to extract from the fuse block. Various devices have been employed to extract and replace fuses, but there is a need for a more convenient method.

Fuse blocks are also known that include integral mechanisms for mechanically detaching the fuses from the fuse holders. One such fuse block is manufactured by the Gould Corporation under the catalog number US3J31. This combination of fuse block and extractor retains the fuses in a pivotal assembly that includes an operating lever for mechanically removing a fuse from the fuse block connectors, and inserting a new fuse. However, while this device is relatively convenient to use, it does not address the problem of removing and replacing fuses from existing fuse blocks. This is because using it would require that the entire fuse block be replaced, and the device is physically somewhat larger than a conventional fuse block and therefore may not be useable in existing equipment where there is insufficient space to mount it.

Moreover, the device is relatively expensive compared to a basic fuse block, and cost considerations may prevent its use except in certain applications.

Another problem with cartridge fuses of the type to which this invention is addressed, is that a blown fuse looks identical to a good fuse. In cases where multiple fuses are used to protect multiple phases, it is usually impossible to determine by observation alone which fuse of a plurality of fuses is blown. While a blown fuse can easily be detected with an electrical multi-meter, this requires additional equipment that may not be handy when the time comes to identify and replace a blown fuse.

SUMMARY OF THE INVENTION

It is an object of this invention to provide a fuse puller that can be used both to extract and replace high current fuses from fuse blocks.

It is another object of this invention to provide a fuse puller having a built in fuse integrity indicator for assisting in the identification of blown fuses.

Briefly stated, and in accordance with a presently preferred embodiment of the invention, a fuse puller includes a generally cylindrical fuse receiving portion, a lifting and inserting tower attached to the cylindrical fuse receiving portion, and a gripping head attached to the tower.

In accordance with another aspect of the invention, the tower portion of a fuse extractor and replaced in accordance with this invention is hollow and incorporates a continuity detector having an indicator for indicating the condition of a fuse.

In accordance with another aspect of the invention, a fuse extractor and puller includes first and second spring contacts attached to the continuity checker, and adapted to contact the electrical terminals of a fuse positioned within the extractor and puller.

In accordance with another aspect of the invention, the tower includes a spring clip for resiliently holding the continuity detector within the fuse extractor.

In accordance with another embodiment of the invention, the fuse continuity indicator comprises a light extending through the top of the gripping portion for easy visibility.

In accordance with another aspect of the invention, the light may be pressed downwardly against the gripping portion; the stress created thereby being absorbed by the resilient mounting for the indicator board, thereby preventing damage.

BRIEF DESCRIPTION OF THE DRAWINGS

The novel aspects of the invention are set forth with particularity in the appended claims. The invention itself, together with further objects and inventions thereof may be more readily understood by reference to the following detailed description of a presently preferred embodiment thereof, taken in conjunction with the accompanying drawing in which:

DETAILED DESCRIPTION OF THE PREFERRED EMBODIMENT

Figure 1:
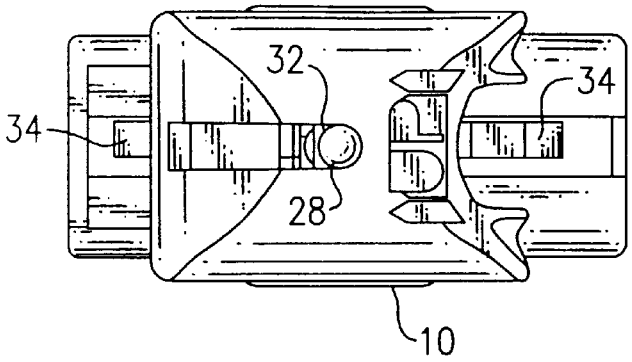
FIG. 1 is a top plan view of a fuse puller in accordance with the invention.
Figure 2:
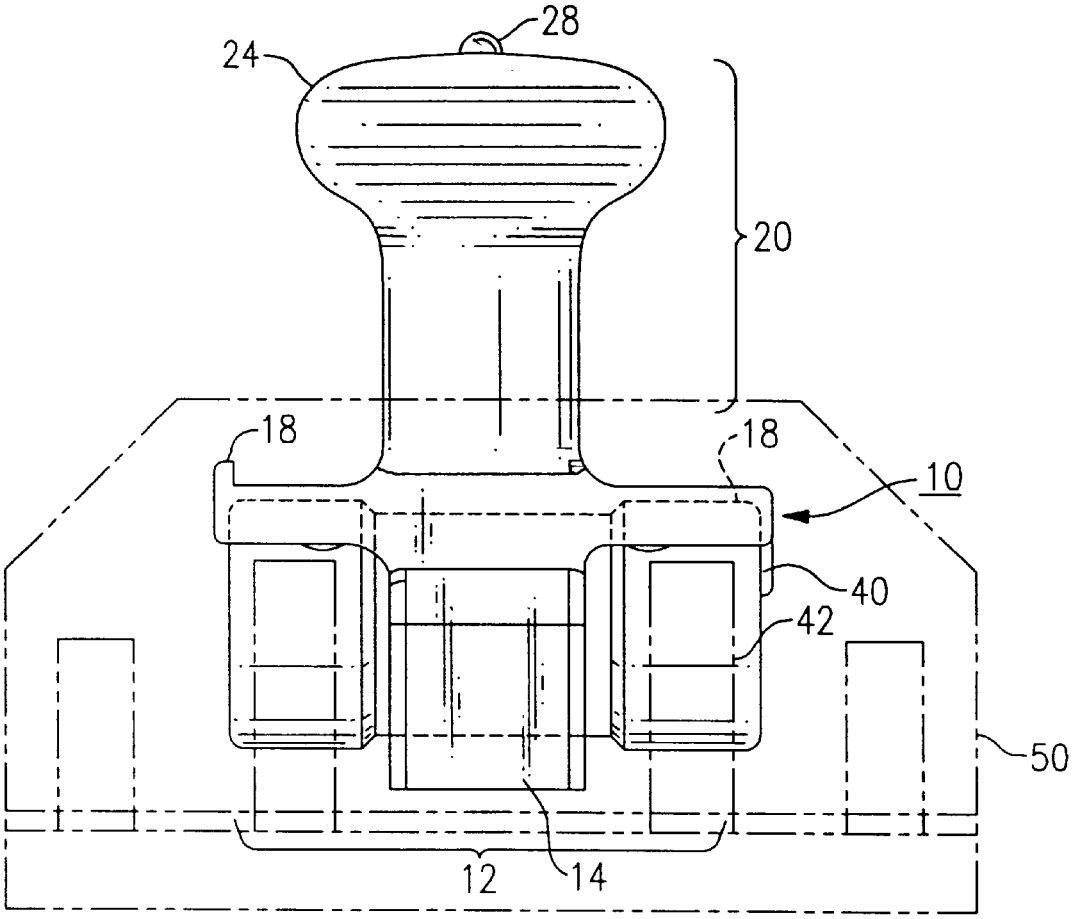
FIG. 2 is a side elevation of the fuse puller sitting in a fuse block.
Figure 3:
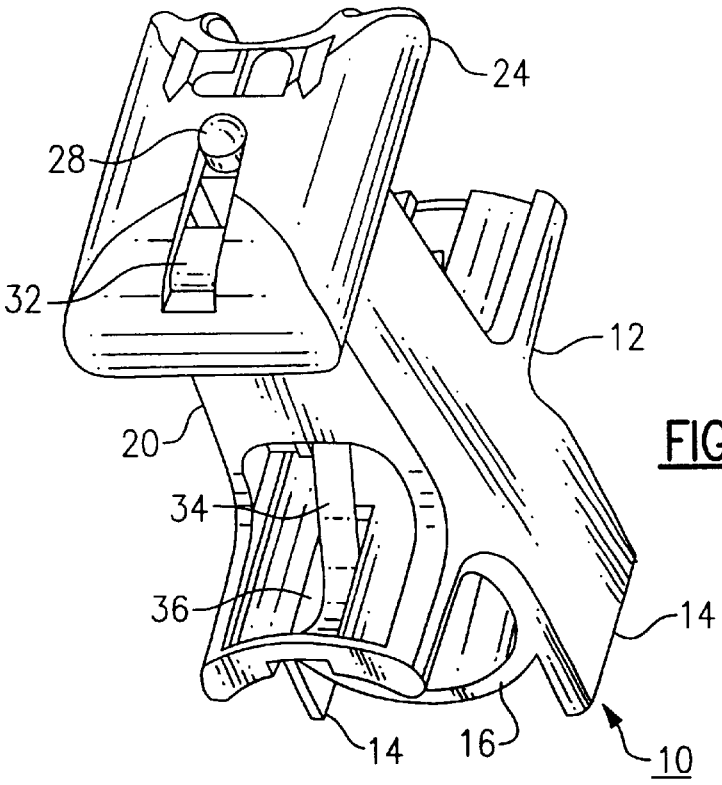
FIG. 3 is a top front perspective view of the fuse puller.
Figure 4:
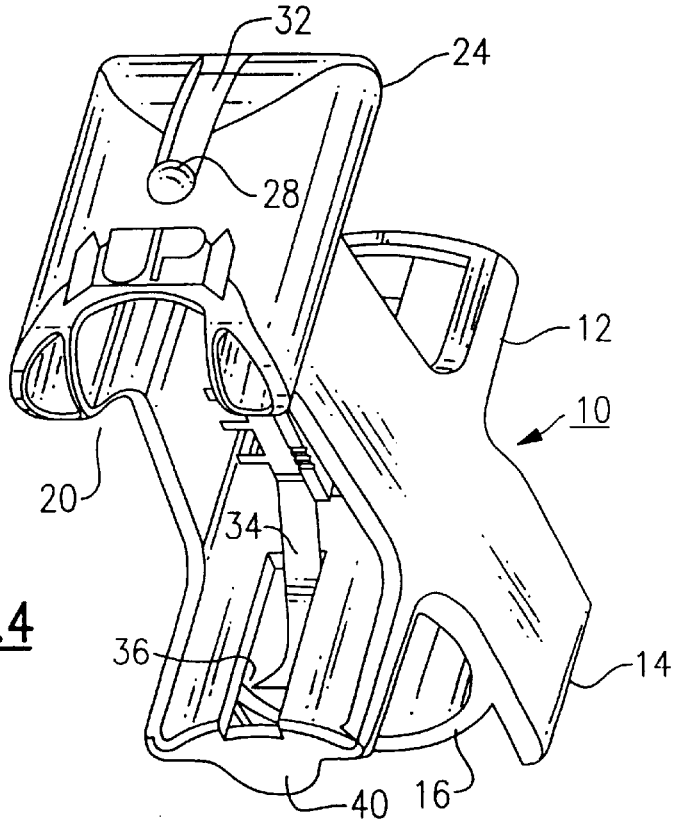
FIG. 4 is a top rear perspective view of the fuse puller.
Figure 6:
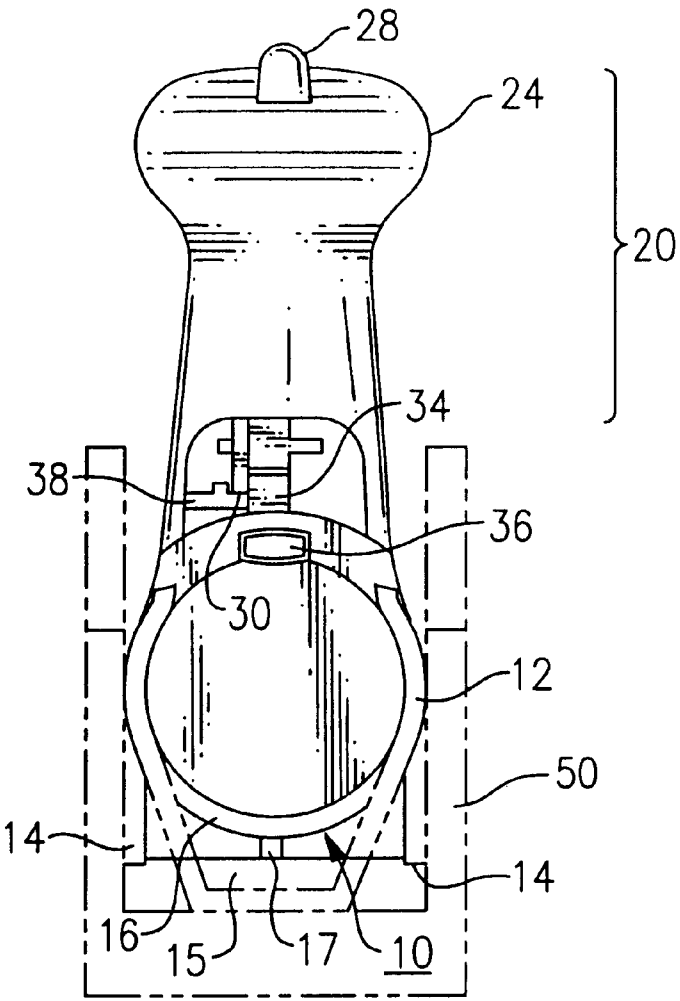
FIG. 6 is a left side elevation of the fuse puller sitting in a fuse block.
Figure 5:
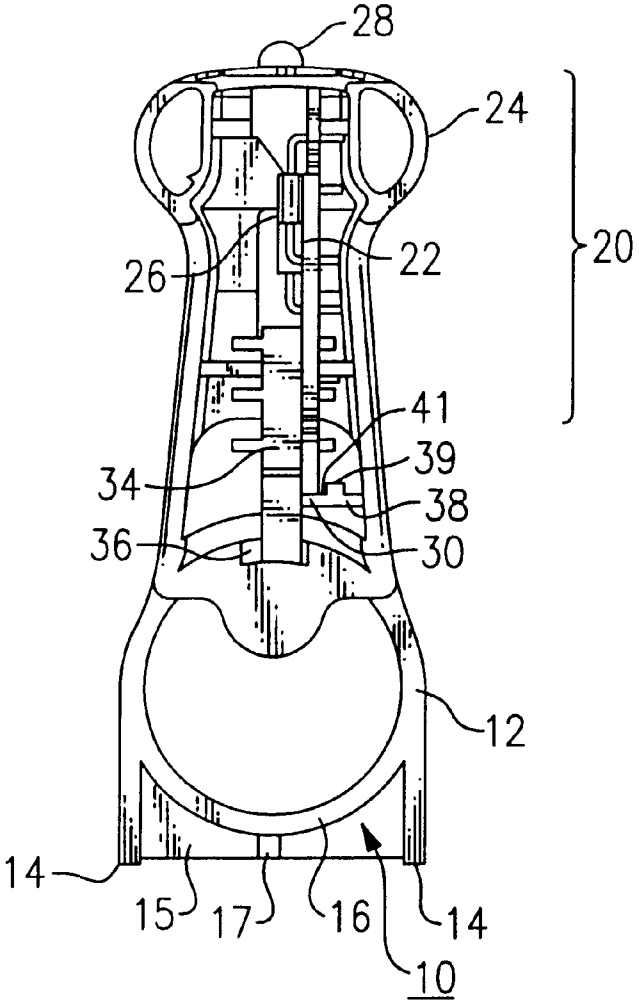
FIG. 5 is a right side elevation view of the fuse puller.

In the several figures, like reference numerals designate the same components of the fuse puller and reference is made generally to FIGS. 1 through 6 in the following description.

The fuse puller is indicated generally at 10 and is especially adapted to be used in conjunction with conventional fuse blocks of the type widely employed for holding cartridge fuses of relatively high amperage ratings, such as 20:100 amps or more. Such fuses are used to protect high power electrical equipment primarily but not necessarily in industrial applications.

The present fuse puller addresses the disadvantages of known fuse pullers and provides a device that can be used with existing fuse blocks without modification to the fuse blocks and is inexpensive and compact.

Referring now to the figures, the fuse puller designated generally at 10 includes a base 12 having a generally rectangular cross section sized to fit within a corresponding recess in a fuse block 50 of conventional construction. The base includes first and second downwardly depending legs 14 arranged generally tangent to a cylindrical fuse engaging section 16 adapted to surround the body of a fuse, preferably between the contact ends thereof.

The cylindrical fuse-engaging portion 16 is generally continuous, so that it may exert both upward pressure on a cartridge fuse to remove it from a fuse block, and downward pressure to insert it into a fuse block. The cylindrical fuse engaging section 16 includes first and second extensions 18 having generally cylindrical inner and outer surfaces extending over the top of the fuse contacts, for engaging and assisting in the insertion of a fuse into a fuse block 50.

An upwardly extending tower portion 20 is attached to the base above the first and second extensions. The tower portion is preferably hollow and receives an indicator circuit board 22, as will be described in more detail later. The tower portion terminates in a squared easy to grip handle 24, particularly adapted to be grasped by a user for extracting or inserting a fuse in a fuse block. The handle 24 is preferably substantially rectangular in cross section, and includes bolt end and side portions that project outwardly from the tower portion of the fuse puller. Preferably, the tower portion 20 is tapered slightly inwardly from the base 12 to the handle 24 to increase the grippable surface of the fuse puller.

In order to provide a structure that can be injection molded, the base, tower, and handle are preferably formed with one substantially open surface and an opposed substantially closed surface. The particular structure of the fuse puller that allows it to be injection molded is a preferred feature, but not an essential feature of the invention.

Preferably, the fuse puller of this invention is provided with an integral continuity detector 26. The continuity detector 26 is formed on a printed circuit board 22, and includes an indicator lamp 28 such as a light emitting diode or a gas discharge lamp, such as a neon lamp, together with a current limiting resistor, and a rectifier diode in the case where a light emitting diode is used as an indicator. The printed circuit board to which the foregoing components are attached is preferably mounted within the hollow tower portion 20 of the fuse puller.

A cantilever beam 30 having a pair of spaced apart bosses forming a channel is attached to one inside wall of the tower portion of the fuse puller. The handle portion of the fuse puller is preferably provided with an opening 32 through which the indicator light projects to increase visibility of the light. A pair of spring contacts 34 is attached to the continuity detector circuit at one end of the contacts. The contacts 34 were checked outwardly from the printed circuit board and downwardly through first and second slots 36 formed in the extended portions of the fuse puller into a position to engage the conductive end caps of a cartridge fuse. Preferably the contacts 34 are made from resilient material, such as spring stock, and have relatively low resistance.

The circuit of the indicator is arranged so that when the fuse is intact, that is when there is very slow resistance between its end caps, substantially no voltage flows through the indicator circuit, and the light remains dark. When the fuse blows, a substantial portion of the circuit voltage appears across the contacts and illuminates the indicator light. Because the indicator light is visible through the top of the handle of the fuse puller, the condition of the fuse may be determined easily without the need for pulling a fuse from the fuse block 50.

Because the indicator lamp 28 extends above the upper surface of the handle of the fuse puller, pressure may be exerted on the lamp when a fuse is being inserted in a fuse block 50. Because the lamp is preferably securely attached to the printed circuit board, there is a risk of damage to the lamp if pressure on the handle of the fuse puller is inadvertently or unavoidably applied to the lamp. Accordingly, a preferred embodiment of the invention includes resilient cantilevered support 38 for the bottom edge of the surface board that yields to pressure applied to the lamp by flexing to prevent damage to the lamp or the other components of the circuit board, or the circuit board itself, should the indicator lamp be subjected to potentially damaging pressure during insert of a fuse into a fuse block.

The upper surface of the fuse puller also comprises the word "UP" 40 with two arrows pointing in the direction in which the fuse puller should be inserted. This is to help prevent a user from inserting the fuse puller and fuse upside down. If a user attempted to insert a fuse with the fuse puller upside down, the fuse may drop out.

Figure 7:
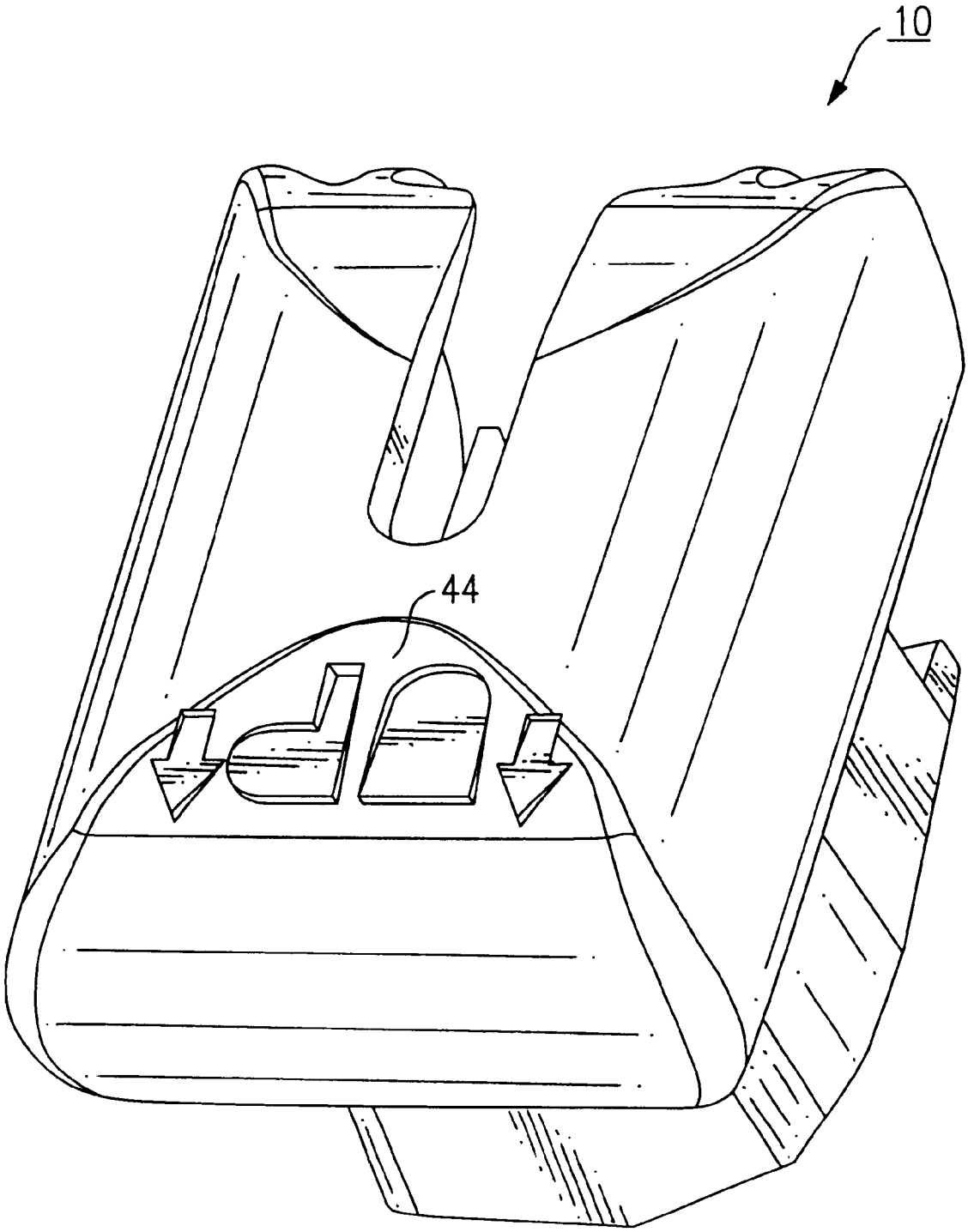
FIG. 7 illustrates the characters etched on the upper surface of the fuse puller in detail.

The UP characters and arrows are molded onto this upper surface. The molds used to make these fuse pullers are automated two piece molds. A special character molding design had to be created so that the characters would not be destroyed when the two pieces were separated. As can be seen in FIG. 7, the characters are molded so that the mold extends deepest into the upper surface furthest from the edge of the fuse puller. This prevents the characters from being obliterated upon removal of the exterior mold piece.

The shape of the upper surface eases the process of molding the characters onto the surface. Because the upper surface gradually slopes downward, it is possible to have the part of the character closest to the edge of the handle (formed furthest inside the mold) actually protrude from the surface of the handle. While the part of the mold cutting into the surface of the handle actually decreases in size towards the edge of the mold. It cuts deeper into the handle because the handle extends higher there.

While the invention has been described in connection with a presently preferred embodiment thereof, various modifications and changes may occur to those skilled in the art without departing from the true spirit and scope of the invention, which accordingly is intended to be defined solely by the appended claims.

What is claimed:

1. A fuse puller/holder, comprising:

a base;

a tower extending upwardly from the base;

a blown fuse detector circuit inside the tower, the circuit enabling the user to determine whether a fuse is operational without actual removal of the fuse from a fuse holder, wherein the blown fuse detector circuit includes electrical contacts between the ends of the fuse and the blown fuse detector circuit; and an indicator connected to the blown fuse detector circuit.

2. The fuse puller of claim 1, where the indicator is resiliently mounted to the tower.

3. The fuse puller of claim 2, further comprising an opening in the tower, through which the indicator may be clearly seen.

4. The fuse puller of claim 1, where the contacts comprise a resilient material characterized by relatively low resistance.

5. The fuse puller of claim 1, where the indicator is a lamp.

6. The fuse puller of claim 5, where the lamp is a light emitting diode.

7. The fuse puller of claim 1, where the indicator is a dial.

8. The fuse puller of claim 1, where the contacts are exposed.

9. The fuse puller of claim 1, where the contacts are a pair of spring contacts.

10. A fuse holder/puller for a fuse, comprising:

a base section which retains said fuse during and after said fuse is inserted into a fuse block;

a tower portion connected to said base section;

an indication lamp in said tower portion visible from outside said fuse holder/puller; and an electrical connection between said indication lamp and said fuse, such that when said fuse is inserted into said fuse block which is powered, said indication lamp indicates whether said fuse is conductive or non-conductive.

11. A fuse holder/puller according to claim 10, wherein said indication lamp is OFF when said fuse is conductive and said indication lamp is ON when said fuse is non-conductive.

12. A fuse holder/puller according to claim 10, wherein said base section includes a fuse stop on one end thereof.

13. A fuse holder according to claim 12, wherein an upper surface of said tower portion includes an indicia recessed into said upper surface, wherein a portion of said indicia closest to said indication lamp extends deeper into said upper surface than a portion of said indicia furthest away from said indication lamp.

14. A fuse holder/puller according to claim 10, further comprising a circuit board resiliently mounted inside said tower portion wherein said indication lamp is mounted to said circuit board.

15. A fuse holder/puller according to claim 10, wherein said electrical connection includes a pair of spring contacts.

* * * * *